United States Patent [19]

Oppenberg

[11] 4,265,613

[45] May 5, 1981

[54] SAFETY DEVICE FOR AN OIL BURNER

[75] Inventor: Rolf Oppenberg, Wesel, Fed. Rep. of Germany

[73] Assignee: Deutsche Babcock Aktiengesellschaft, Fed. Rep. of Germany

[21] Appl. No.: 17,233

[22] Filed: Mar. 5, 1979

[30] Foreign Application Priority Data

Mar. 8, 1978 [DE] Fed. Rep. of Germany ..... 2809962

[51] Int. Cl.[3] ..... F23D 11/38

[52] U.S. Cl. ..... 431/121; 137/107; 251/77; 222/571

[58] Field of Search ..... 431/30, 31, 121; 222/571; 138/31; 251/77, 138; 137/107

[56] References Cited

U.S. PATENT DOCUMENTS

| | | | |
|---|---|---|---|
| 359,315 | 3/1887 | Cregier | 138/31 |
| 3,343,826 | 9/1967 | Manny et al. | 431/121 |
| 3,951,311 | 4/1976 | Johansson | 138/31 |
| 3,987,708 | 10/1976 | Uhrich | 138/31 |
| 3,987,810 | 10/1976 | Bjorklund | 431/121 |
| 4,142,707 | 3/1979 | Bjorklund | 222/571 |

*Primary Examiner*—Joseph Man-Fu Moy
*Attorney, Agent, or Firm*—McGlew and Tuttle

[57] ABSTRACT

A safety device for an oil burner includes a pump which has a drive cylinder portion with a double-acting piston movable therein which is connected through a connecting rod to a suction piston portion which is movable in a suction portion of the pump cylinder. The oil burner is supplied with fuel oil from a supply line having a shutoff valve or valves which are connected through a suction line to the suction part of the piston. The suction portion is connected through a check valve to a return line and the drive cylinder is connected on respective opposite sides of the piston through valve means for regulating the movement of the drive piston so that it moves after the burner is turned off to displace the suction piston to effect a suction on the supply line to the oil lance of the burner so as to withdraw the oil therefrom.

5 Claims, 1 Drawing Figure

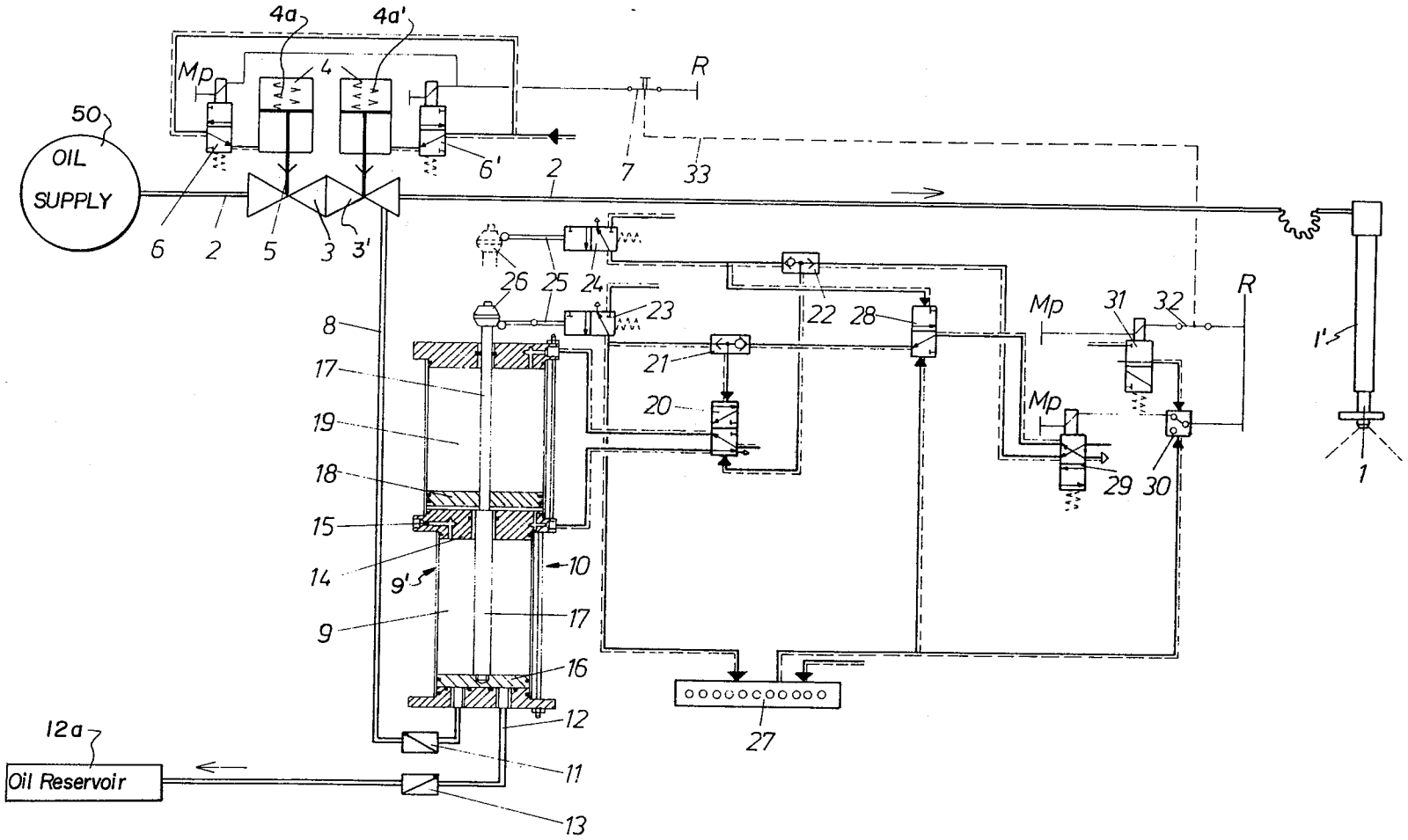
OIL SUPPLY
Oil Reservoir
Mp
R

SAFETY DEVICE FOR AN OIL BURNER

FIELD AND BACKGROUND OF THE INVENTION

This invention relates to oil burners in general and, in particular, to a new and useful safety device for an oil burner having its oil lance connected to an oil supply line in which an oil shutoff valve is provided.

DESCRIPTION OF THE PRIOR ART

Up to the present time, the residual oil remaining between the oil shutoff valve and the oil nozzle, after the oil burner is shut off, has been blown out into the furnace by means of steam or compressed air and burned under supported ignition. This prevents the residual oil from dripping out in an uncontrolled manner into the still hot furnace where it would evaporate and form and explosive mixture with the air, with the hazard of a deflagration. In addition, it is ensured that upon shutting off a heavy oil burner for a longer period, the residual oil in the oil lance will cool down and clog the lance.

With some kinds of firing, the prior art method involves considerable risks since it does not securely prevent unburned residual oil from passing into the furnace. For example, the oil lance of a top-fired furnace becomes empty very rapidly. Up to the ignition of the pilot burner and, particularly, with a failure of the pilot burner, the penetration of oil into the fireplace cannot be prevented. At a disturbance of the boiler or in emergency cases, the oil supply is immediately shut off, without blowing out and igniting the residual oil.

With oil return pressure atomizer burners, more than a double amount of residual oil, as compared to other atomizing methods, is present between the shutoff valves, due to the return portion and the large amount of returning oil. During the blowout of the residual oil, the oil proportion coming from the return branch remains untreated so that the oil blown into the furnace is only partly atomized and frequently it happens that a portion of the oil fails to be burned and spatters the boiler walls. Because of the larger residual oil amounts, the risk of deflagration upon a failure in the ignition is even greater with these burners.

To prevent the residual oil from escaping, it is known to provide a nozzle needle in oil-return burners, which closes the nozzle as soon as the oil supply is shut off. For the same purpose, it is also known to provide a check valve in the zone of the nozzle. Even in its retracted position, the nozzle of a shutoff oil burner is still subjected to high thermal stresses from the furnace. In consequence, it cannot always be ensured that the shutoff members located in the zone of the nozzle will close tightly.

SUMMARY OF THE INVENTION

The present invention is directed to a safety device which securely prevents residual oil from subsequently passing into the furnace. To this end, and in accordance with the invention, it is provided that at a location between the oil lance and the shutoff valve, the oil supply line is connected through a suction line to the piston space of a pump. With the aid of this pump, and after closing the shutoff valves for the oil, the residual oil amount is removed by suction from the oil supply line and the burner lance. The pump itself is installed in a zone where it is not exposed to thermal load.

In the simplest design, the volume of the piston space is made equal to the total volume of the residual oil from the oil supply line and the oil lance. In such a case, a single piston stroke is necessary. However, it is safer to remove the amount of residual oil by a plurality of piston strokes. For this reason, a development of the invention provides that a return line, equipped with a check valve, is connected to the piston space of the pump. Another check valve is provided in the suction line at the same time. In this design, the residual oil amount can be forced back into the oil tank.

In order to start with the removal of the residual oil immediately after the shut off of the oil supply, it is provided to control the drive of the pump by means of a control unit which is coupled to the actuator of the oil shutoff valve.

Accordingly, an object of the invention is to provide a safety device for an oil burner which is supplied with fuel oil through a supply line having a shutoff valve therein and wherein the supply line is connected through a suction line to a pump which has a drive cylinder portion in which a drive piston is movable, the drive piston being connected through a connecting rod to a suction piston movable in a suction cylinder portion of the pump and wherein the drive cylinder portion is operated by valve means in accordance with the operation of the burner to cause movement of the suction piston to withdraw the fuel oil through the suction line and one shutoff valve so that the oil is withdrawn from the burner during a shut off.

A further object of the present invention is to provide a safety device for an oil burner which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a schematic showing of a safety device for an oil burner constructed in accordance with the present invention.

DESCRIPTION OF THE PREFERRED EMBODIMENT

Referring to the drawing in particular, the invention embodied therein, comprises, a safety device for an oil burner 1' having a burner lance 1 which is supplied with fuel oil through an oil supply line 2 from an oil supply 50.

The oil is supplied from the oil tank through an oil supply line 2 to an oil lance 1 of oil burner 1'. Two oil shutoff valves 3 and 3' are provided in the oil supply line 2. The drawing shows two identical shutoff valves 3 and 3' which are designated as quick-acting valves. The actuator of each shutoff valve 3 comprises a cylinder 4 in which a spring-loaded piston 5 is mounted for displacement and is unilaterally exposed to compressed air. The admission of compressed air to each of cylinders 4 is controlled by two electromagnetically actuated 3/2-way valves 6 and 6'. The control pulse for both of the 3/2-way valves 6 is transmitted through a switch 7.

A suction line 8 is connected to the oil shutoff valve 3' which is closer to oil lance 1 than the valve 3. Suction line 8 leads to the piston space 9 of a cylinder 9' of a piston pump 10. Suction line 8 is equipped with a check valve 11 in front of its connection to piston space 9. A return line 12 is also connected to piston space 9. Return line 12 leading to a reservoir **12*a* is also equipped with a check valve 13. A cover or center wall 14 which is mounted on the side remote from the connections of suction line 8 and return line 12 is provided with a vent bore 15**.

Piston 16 of piston pump 10 is moved by a piston rod 17 passed through cover 14, with the aid of a double-acting piston 18 which can be loaded on both sides. The double-acting piston 18 is guided in a drive cylinder 19 which is attached to piston pump 10.

Piston pump 10 is actuated by means of a control unit which is described hereinafter. The supply of compressed air to the piston spaces above and below double-acting piston 18 is controlled by a pneumatically operated 5/2-way valve 20 which is provided in the lines supplying drive cylinder 19 with compressed air. Valve 20 is controlled by two shuttle valves 21 and 22 which are actuated by 3/2-way valves 23 and 24, respectively. Valves 23 and 24 are, in turn, actuated by a feeler 25, against the action of a return spring. Each feeler 25 engages a heas portion 26 of piston rod 17 in the end position thereof.

The number of strokes of piston pump 10 is set by means of a pulse counter 27 which is connected, on the one hand, to shuttle valve 21 and feeler-actuated 3/2-way valve 23 and, on the other hand, through a pneumatic 3/2-way valve 28, to shuttle valve 22 and feeler-actuated 3/2-way valve 24. In addition, pneumatic 3/2-way valve 28 is connected to shuttle valve 21.

Pneumatic 3/2-way valve 28 and shuttle valve 22 are connected to a magnetically actuated 4/2-way valve 29 which, on the electrical side, is connected to a pneumo-electrical converter 30. Converter 30 is connected to pulse counter 27 and to another electromagnetically actuated 3/2-way valve 31 on its compressed air side. Valve 31 is actuated by a switch 32. The control unit, comprising the above-described valves 21, 22, 23, 24, 28, 29, and 31, pulse counter 27 and converter 30 is coupled to 3/2-way valves 6 and 6' which control the actuation of shutoff valves 3 and 3'. For this purpose, switch 7 is connected to a switch 32 through an actuating line 33.

the operations which can be performed with the pneumo-electrical control described in the foregoing, and in more detail hereinafter, may also be performed with purely electrical, pneumatic, hydraulic, or mixed drives and controls.

Starting from the operating position of the oil burner shown in the drawing, the inventive safety device operates as follows: With oil lance 1 in operation, the two oil shutoff valves 3 are open, and piston 16 of piston pump 10 is in its closing position as shown in the drawing. The two switches 7 and 32 are closed, so that the pistons of shutoff valves 3 are held in open position through 3/2-way valves 6, 6'. Electromagnetic 4/2-way valve 29 and electromagnetic 3/2-way valve 31 are also energized, so that double-acting piston 18 of drive cylinder 19 is loaded with compressed air from above, through 5/2-way valve 20. As soon as the two switches 7 and 32 receive the command signal to open, 3/2-way valves 6 and 6' switch to the open position, so that the shutoff valves 3 and 3' are closed by the spring action of a spring **4*a* and 4*a'*. At the same time, converter 30 is actuated through electromagnetic 3/2-way valve 31. 4/2-way valve 29 switches over, compressed air flows through pneumatic 3/2-way valve 28 and shuttle valve 21 and reverses pneumatic 3/2-way valve 20. Double-acting piston 18 of drive cylinder 19 is now loaded with compressed air from below and moves upwardly. Thereby, by means of piston 16 of piston pump 10 which is connected to piston 18 through piston rod 17, the residual oil is taken into piston space 9, through check valve 11. In its upper end position, piston rod 17 activates feeler 25 of 3/2-way valve 24 which acts as a limit switch. Pneumatic 3/2-way valve 28 is thereby switched to venting and 5/2-way valve 20 is reversed through shuttle valve 22, so that double-acting piston 18** moves downwardly.

At the same time, piston 16 of piston pump 10 forces the oil from piston space 9 through check valve 13 into return line 12 and therefrom into the oil tank. In its lower end position, piston rod 17 actuates feeler 25 of 3/2-way valve 23 acting as a limit switch, and 5/2-way valve 20 is again reversed through shuttle valve 21.

Simultaneously, a pulse is delivered to pneumatic pulse counter 27. Double-acting piston 18 starts to move upwards again and a new cycle commences.

This is repeated until the set number of pulses is attained. The pulse counter then delivers a control pulse by which converter 30 is reversed. 4/2-way valve 29 clears the way through the also reversed pneumatic 3/2-way valve 28 and shuttle valve 21 to 5/2-way valve 20. Double-acting piston 18 is now continuously loaded with compressed air from above and remains closed.

While a specific embodiment of the invention has been shown and described in detail to illustrate the application of the principles of the invention, it will be understood that the invention may be embodied otherwise without departing from such principles.

What is claimed is:

1. A safety device for an oil burner having an oil lance, comprising, a fuel oil supply line connected to said oil lance, a fuel oil shutoff valve in said supply line, a pump comprising a pump housing having a drive cylinder space, a suction piston space, a double-acting drive piston movable in said drive cylinder space, a suction piston movable in said suction piston space, a piston rod connected to said drive piston and suction piston having at least a portion disposed therebetween, a suction line extending between said suction space and said shutoff valve in said supply line and control means connected between said burner lance and said fuel oil shutoff valve in said supply line and connected between said pump and said burner lance to move said drive piston to cause movement of said suction piston and withdrawal of the oil through said supply line from said burner lance when said burner is shut off.

2. A safety device for an oil burner, as claimed in claim 1, wherein said suction line is connected to said oil shutoff valve.

3. A safety device for an oil burner, as claimed in claim 1, including a check valve in said suction line permitting flow of fuel oil from said supply line to said suction space of said pump.

4. A safety device for an oil burner, as claimed in claim 1, including a return line connected to said suction space having a check valve permitting flow out of said suction space.

5. A safety device for an oil burner, as claimed in claim 1, wherein said control includes a fluid pressure line connecting into said cylinder space on respective sides of said drive piston and valve means for regulating the flow of fluid pressure so as to cause movement of said drive cylinder when said burner is shut off and so as to pressurize said drive piston so as to move it in a direction to cause said suction piston to maintain a pressure on the suction return line.

* * * * *